US009004978B2

(12) United States Patent
Shaw

(10) Patent No.: US 9,004,978 B2
(45) Date of Patent: Apr. 14, 2015

(54) SWINGING BOB TOY WITH REVERSIBLY SEPARABLE BOBS

(71) Applicant: Laurence J. Shaw, San Francisco, CA (US)

(72) Inventor: Laurence J. Shaw, San Francisco, CA (US)

( * ) Notice: Subject to any disclaimer, the term of this patent is extended or adjusted under 35 U.S.C. 154(b) by 0 days.

(21) Appl. No.: 13/714,419

(22) Filed: Dec. 14, 2012

(65) Prior Publication Data

US 2013/0244540 A1 Sep. 19, 2013

Related U.S. Application Data

(60) Provisional application No. 61/630,683, filed on Dec. 16, 2011.

(51) Int. Cl.
*A63H 33/00* (2006.01)
*A63B 67/08* (2006.01)

(52) U.S. Cl.
CPC ..... *A63H 33/00* (2013.01); *A63B 67/08* (2013.01)

(58) Field of Classification Search
USPC ..... 446/247, 490
See application file for complete search history.

(56) References Cited

U.S. PATENT DOCUMENTS

| | | | | | |
|---|---|---|---|---|---|
| 93,249 | A | * | 8/1869 | Trebe | |
| 2,161,154 | A | * | 6/1939 | Gertler | 446/253 |
| 3,850,429 | A | * | 11/1974 | Clifford | 482/122 |
| 4,878,868 | A | * | 11/1989 | Shaw | 446/75 |
| RE34,208 | E | * | 3/1993 | Shaw | 446/75 |
| 6,629,873 | B2 | * | 10/2003 | Shaw | 446/490 |
| 6,896,578 | B2 | * | 5/2005 | Shaw | 446/490 |
| 7,137,863 | B2 | * | 11/2006 | Hiebert | 446/490 |
| 2004/0198174 | A1 | * | 10/2004 | Shaw | 446/490 |

* cited by examiner

*Primary Examiner* — Michael Dennis
*Assistant Examiner* — Urszula M Cegielnik
(74) *Attorney, Agent, or Firm* — Integral Patent; Laurence J. Shaw

(57) ABSTRACT

A swinging bob toy having three bobs constrained on a string, the middle bob being slideably constrained between the two end bobs, and at least one of the bobs being reversibly separable into two partial bobs. A wide variety of new tricks and maneuvers are made possible by the separability of the bobs. The two partial bobs have roughly the same weight thereby providing balanced orbits. Each of the two partial bobs slides less easily along the string than a non-separated bob. The two partial bobs have roughly the same diameter along at least one axis thereby allowing visual illusions to be performed.

22 Claims, 9 Drawing Sheets

SWINGING BOB TOY WITH REVERSIBLY SEPARABLE BOBS

RELATED APPLICATIONS

The present application is based on and claims the priority of provisional patent application Ser. No. 61/630,683 filed Dec. 16, 2011 having the same title and being by the same inventor.

FIELD OF THE INVENTION

The present invention relates to swinging bob toys.

BACKGROUND OF THE INVENTION

U.S. Pat. No. RE34,208 teaches a swinging bob toy having three bobs on a string with the middle bob being slideable and constrained on the string between the two end bobs. This toy has been sold under the trademark Astrojax® for over 15 years, and is currently manufactured and marketed by Active People, SA of Binningen, Switzerland. There are a number of varieties of Astrojax manufactured by Active People, SA, including foam-mantled versions, light-up versions, and a version which has liquid-filled bobs where all three bobs are free to slide along the string. Players have developed a large number of tricks and maneuvers with the toy, many of which can be viewed in the tricks section of Active People's website, www.ap-club.net, or in the over 1800 player-posted videos currently on www.YouTube.com. Holding one end bob, the basic orbits are a vertical orbit, a horizontal orbit and a figure-eight pattern. Because the three bobs have the same mass, the orbits have a balanced appearance such as a symmetry in the motions or paths of the bobs. One of the basic tricks is the end-bob switch, where the held end bob is released and the orbiting end bob is grabbed. Because the bobs have the same mass, orbits after an end-bob switch have the same appearance as the orbits prior to the switch.

Another swinging bob toy with three bobs is sold online at www.freedo.info under the trademark TriThology™. The bobs of this toy are slidably constrained to a looped string by small metallic hooks or loops connected to the bobs by swivels, and so the bobs have their centers of mass displaced from the string. Holding one end bob, the basic orbits are a horizontal orbit and vertical oscillations, and there is also a horizontal orbit with superimposed vertical oscillations. Because the three bobs have the same mass, the orbits have a balanced appearance and the same motion regardless of which bob is held.

A swinging bob toy with two sliding bobs on a tethering means is described in U.S. Pat. No. 7,137,863. This toy is sold online at www.aroundsquare.com under the trademarks Dubulo™ and Monkey Knuckles™, and videos showing its use can also be found on www.YouTube.com. Although the bobs have throughbores through which the string passes so the bobs can slide on the string, the throughbores of Monkey Knuckles™ are straighter and provide more friction than the flared bores of Astrojax® bobs, so Monkey Knuckles™ bobs do not slide as easily as Astrojax® bobs. This allows tricks and maneuvers where friction plays a role in the stability of the motion.

With each of the above-described swinging bob toys, hundreds if not thousands of different types of orbits, tricks and moves are possible. While some of the moves are performable on more than one of the above-described swinging bob toys, the particular construction of each toy provides numerous possibilities not available to the other constructions. In each of the above-described swinging bob toys the bobs are all of the same mass, and in each of the above-described swinging bob toys the geometry/construction is not alterable. It should also be noted that optical tricks or illusions are not facilitated by the construction of the above-described swinging bob toys. Furthermore, it should be noted that in the above-described swinging bob toys all the sliding bobs have the same friction of sliding, i.e., "slideability," and the slideabilities of the bobs are not alterable.

It is an object of the present invention to provide a swinging bob toy with new modes of play.

It is another object of the present invention to provide a swinging bob toy with an alterable geometry/construction.

It is another object of the present invention to provide a swinging bob toy with an alterable number of bobs.

It is an object of the present invention to provide a swinging bob toy with new types of moves, tricks, motions and/or orbits, and particularly, balanced orbits, i.e., orbits where the motions or paths of the bobs have a symmetry, such as a two-fold or mirror symmetry.

It is another object of the present invention to provide a swinging bob toy which provides new visual effects, such as optical and/or magical illusions.

An object of the present invention is therefore to provide a swinging bob toy where at least one bob which is reversibly separable into two bobs.

More particularly, it is an object of the present invention is to provide a swinging bob toy with at least one bob which is reversibly separable into two bobs which can look substantially the same as each other or as the orginal non-separated bob.

Also it is an object of the present invention is to provide a swinging bob toy where at least one bob is reversibly separable into two bobs of roughly equal mass.

Also it is an object of the present invention is to provide a swinging bob toy where at least one bob is reversibly separable into two bobs which have an altered slideability, i.e., a slideability different from that of the unseparated bob.

Additional objects and advantages of the invention will be set forth in the description which follows, and will be obvious from the description or may be learned by practice of the invention. The objects and advantages of the invention may be realized and obtained by means of the instrumentalities and combinations particularly pointed out in the claims.

SUMMARY OF THE INVENTION

The present invention is directed to a swinging bob toy having three bobs on a tethering means. The middle bob has a throughbore through which the tethering means passes and the middle bob is slidable on said tethering means. The middle bob is constrained to the tethering means between the two end bobs. At least one of the bobs is reversibly separable into a first partial bob having a throughbore and a second partial bob having a throughbore.

BRIEF DESCRIPTION OF THE DRAWINGS

The accompanying figures, which are incorporated in and form a part of the present specification, illustrate embodiments of the invention and, together with the description given above and the detailed description of the preferred embodiments given below, serve to explain the principles of the invention.

DETAILED DESCRIPTION OF THE PREFERRED EMBODIMENTS

Figure 1A:
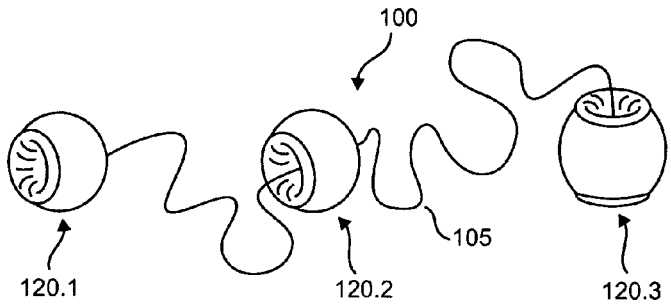
FIG. 1A shows a first preferred embodiment of the toy of the present invention having reversibly separable bobs with the bobs in a non-separated state.
Figure 1B:
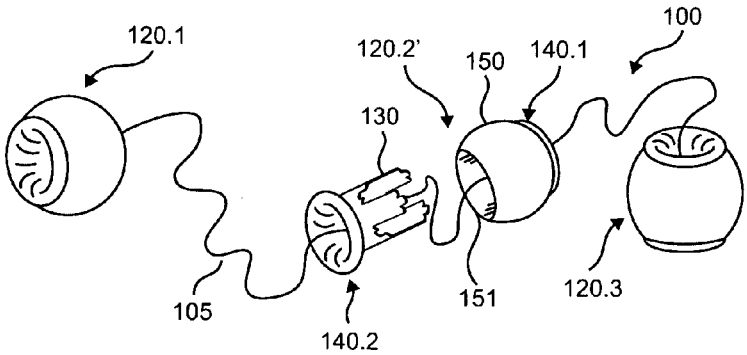
FIG. 1B shows the toy of FIG. 1A with the middle bob in a separated state.
Figure 1C:
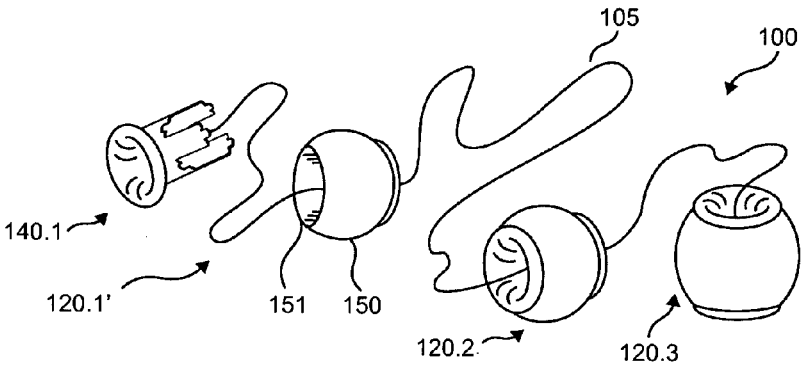
FIG. 1C shows the toy of FIG. 1A with an end bob in the separated state.

A first preferred embodiment of the toy (100) of the present invention is shown in FIG. 1A. The toy (100) has a string (105), or some other type of tethering means, such as a rope, thread or twine, on which are constrained two end bobs (120.1) and (120.3) and a middle bob (120.2). There are many modes of play with the toy (100) in this three-bob state. Holding one end bob (120.1), the basic orbits are a vertical orbit, a horizontal orbit and a figure-eight/butterfly orbit of the middle bob (120.2) and the other end bob (120.3). Other basic orbits, as well as gateway moves, advanced orbits, juggling tricks, string tricks, rebound tricks, and body tricks can be found in the tricks section of www.ap-club.net and in hundreds of player-posted online videos.

Figure 2A:
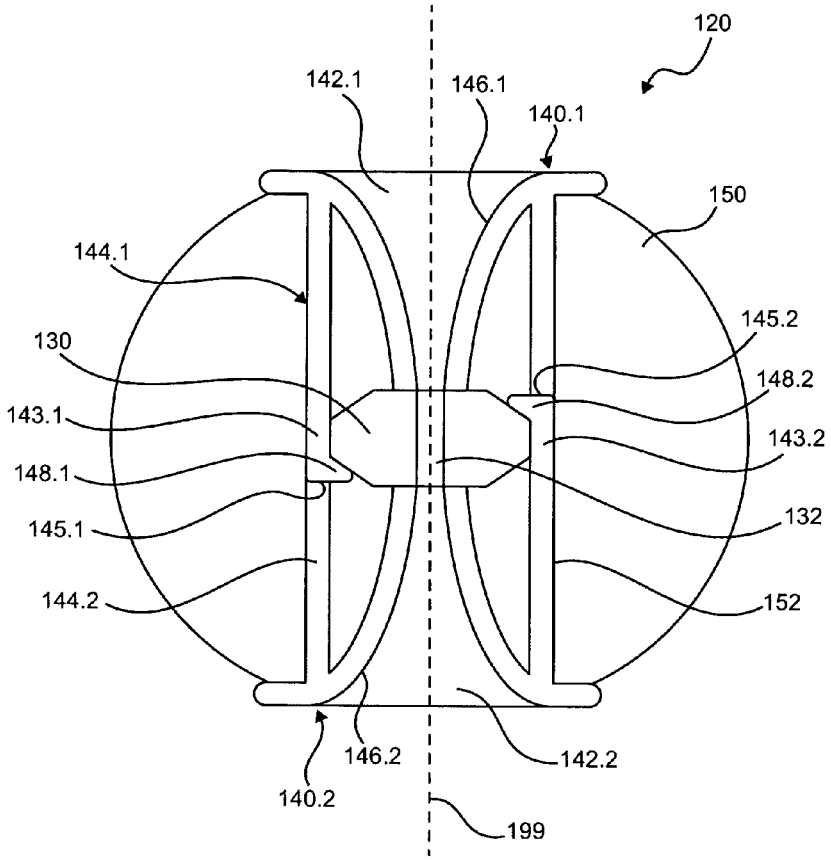
FIG. 2A shows a cross-sectional view of a reversibly separable bob according to the present invention with the bob in the non-separated state.
Figure 2B:
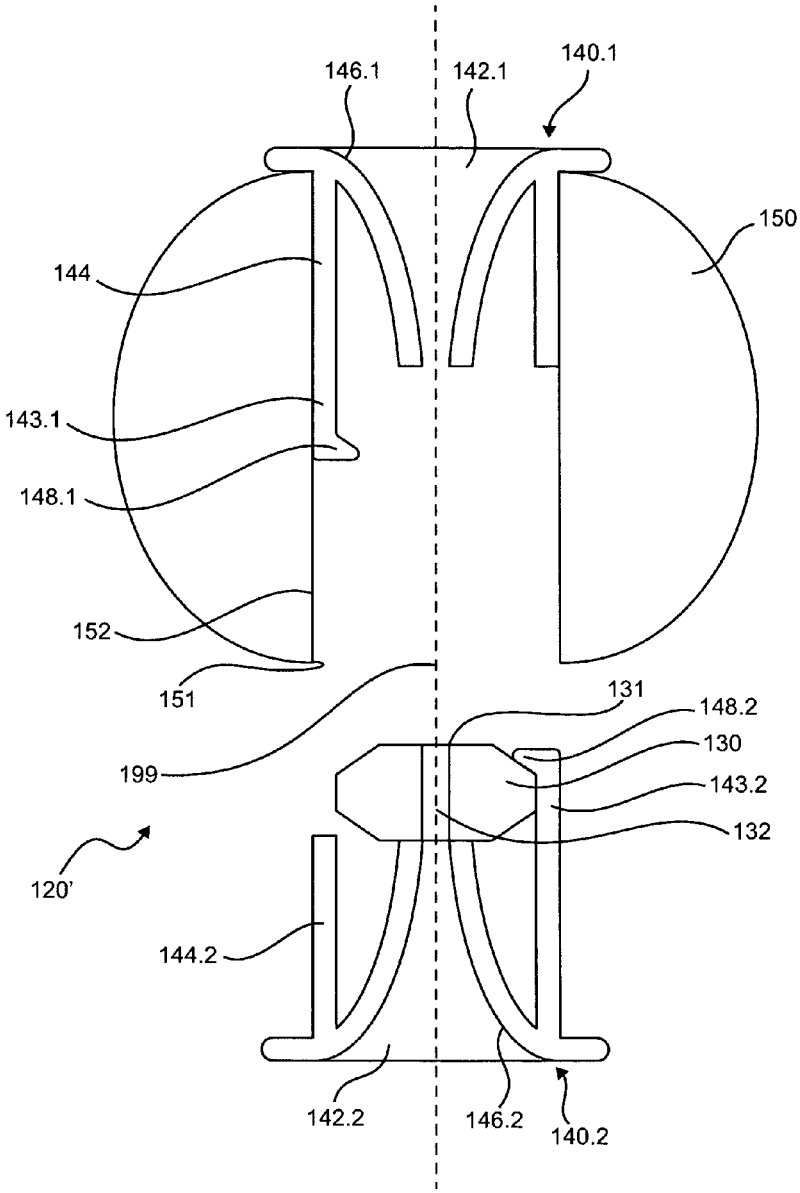
FIG. 2B shows a cross-sectional view of the reversibly separable bob of the present invention with the bob in a separated state with the top spindle in the mantle and the weight in the bottom spindle.
Figure 2C:
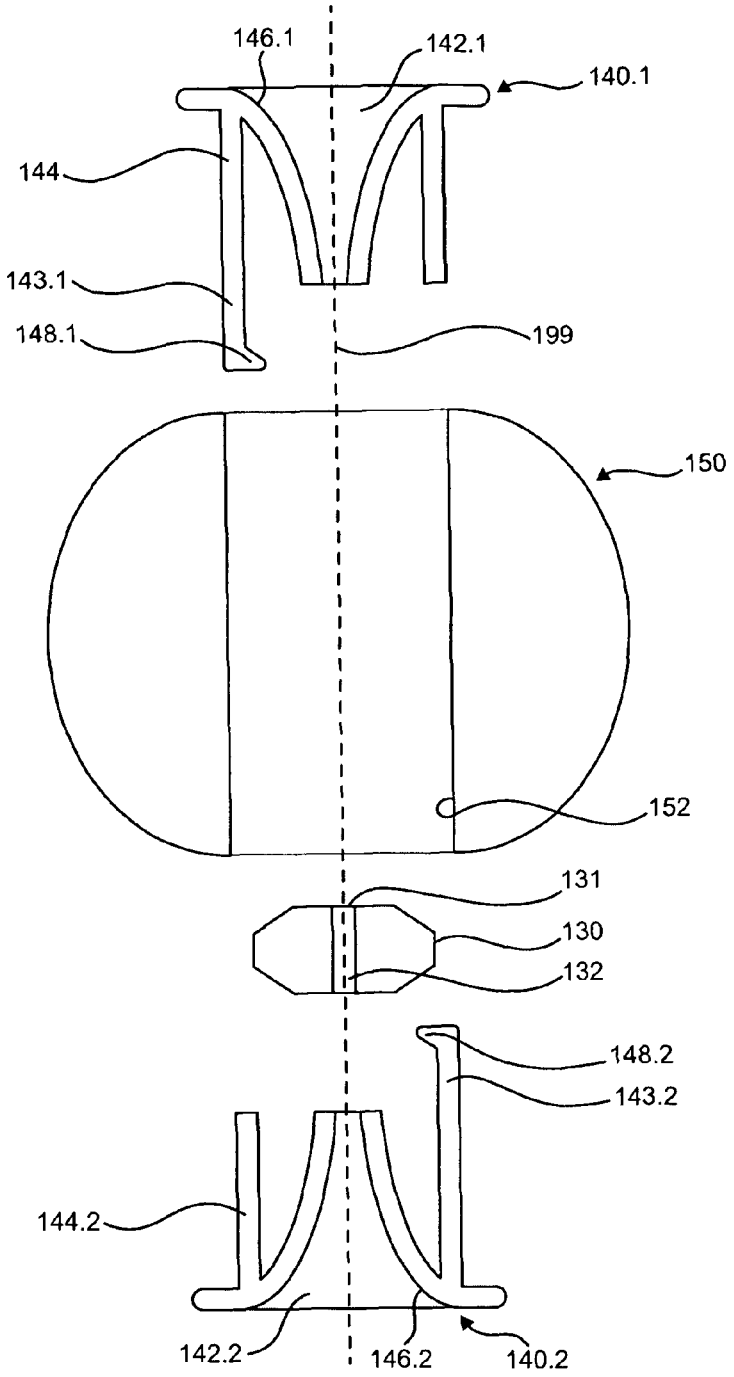
FIG. 2C shows a cross-sectional view of the reversibly separable bob of the present invention with the bob in a completely separated state.
Figure 4A:
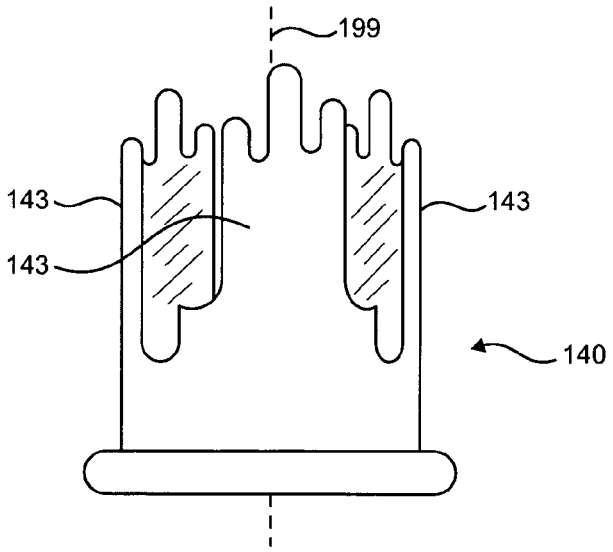
FIG. 4A shows a side view of a spindle half.
Figure 4B:
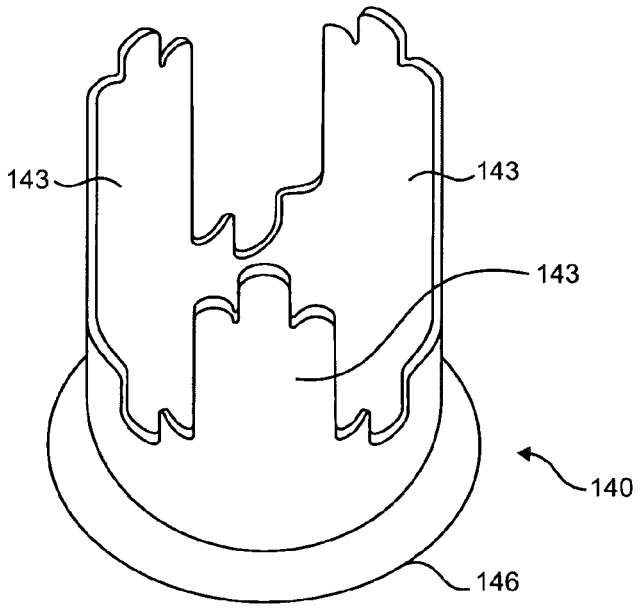
FIG. 4B shows a perspective view of the spindle half of FIG. 4A.
Figure 4C:
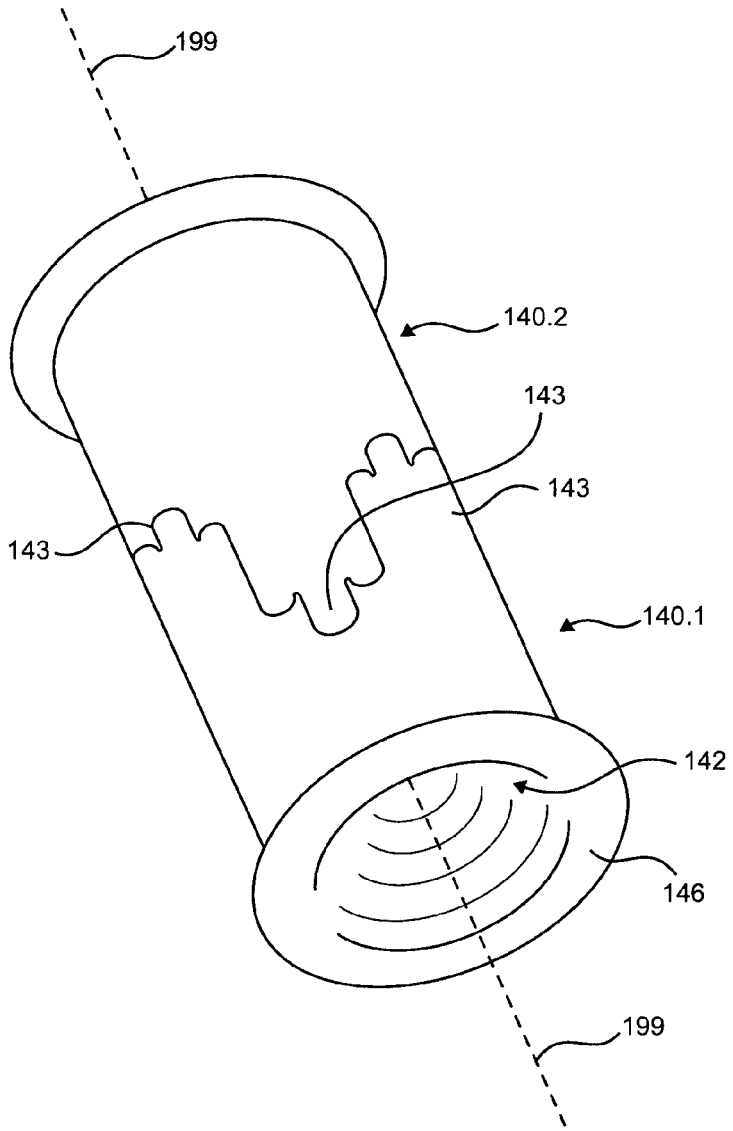
FIG. 4C shows two spindle halves in a mated configuration.

According to the preferred embodiment of the present invention, each of the bobs (120.1), (120.2) and (120.3) has the same construction. (Generically or collectively the bobs (120.1), (120.2) and (120.3) will be referred to with reference numeral 120.) A cross-sectional view of a bob (120) in a non-separated state is shown in FIG. 2A. The bob (120) has a central weight (130) with a throughbore (132), an upper spindle half (140.1), a lower spindle half (140.2), and an outer mantle (150). (The spindles halves (140.1) and (140.2) will be referred to generically or collectively with reference numeral 140. The components of the upper and lower spindles halves (140.1) and (140.2) will with reference numerals in the 14*x*.1 and 14*x*.2 series and will be referred to generically or collectively with reference numeral 14*x*.) As shown in the cross-sectional views of FIGS. 2A, 2B and 2B, the side view of FIG. 4A, and the perspective view of FIG. 4B, each spindle half (140) has a flared bore (142) and an outer frame (144). Each spindle half (140) is cylindrically symmetric about a central axis (199) through the bore (142) except for three wings (143) which have three-fold symmetry about the central axis (199). At the terminal end (145) of each wing (143) is an inwards jutting lip (148). The diameter of the bore (152) of the mantle (150) is slightly greater than the diameter of the frame (144) and less than the outer diameter of the flare (146) of the bore (142). The weight (130) may be removably secured by the wings (143) and lips (148) within both spindles halves (140.1) and (140.2) as shown in FIG. 2A where the bob (120) is in its non-separated state and the mantle (150) is secured on the spindle halves (140) by the outer edges of the flares (146) of the bores (142). Or the weight (130) may be secured in one or the other of the spindles halves (140) as shown in FIG. 2B where the bob (120') (an apostrophe after the reference numeral 120 indicates the separated state) is in the separated state and the weight (130) is held by the bottom spindle half (140.2). The wings (143) have an azimuthal width (i.e., transverse to the throughbore axis (199)) equal to the separation between the wings (143). Therefore, two spindle halves (143) can be mated as shown in FIG. 4C. Because the weight (130) can be secured in either spindle half (140) and two spindle halves (140) can be mated as shown in FIGS. 2A and 4B, two spindle halves (140) can be secured together when both secure a centrally-located weight (130). The weight (130) in each bob (120) lowers the moment of inertia of each bob (120), as described in U.S. Pat. No. RE34,208, providing smoother orbits, particularly vertical orbits. With the weight (130) (which is not visible in FIG. 4C) securing the spindle halves (140.1) and (140.2) in the mated configuration shown in FIG. 4C, the throughbores (142.1) and (142.2) of the spindle halves (140.1) and (140.2) provide a continuation of the throughbore (132) of the weight (130) to provide a throughbore for the string (105) through the bob (120).

Figure 5A:
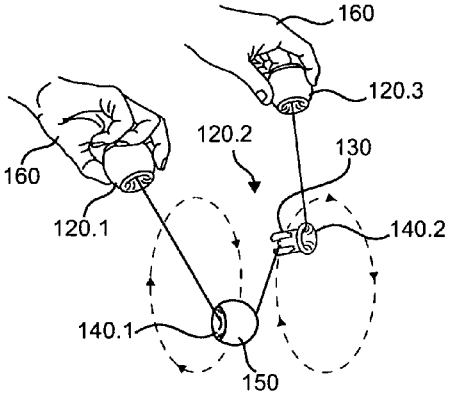
FIGS. 5A, 5B and 5C show the middle bob separated into two partial bobs of roughly equal weight in a balanced orbit.
Figure 5B:
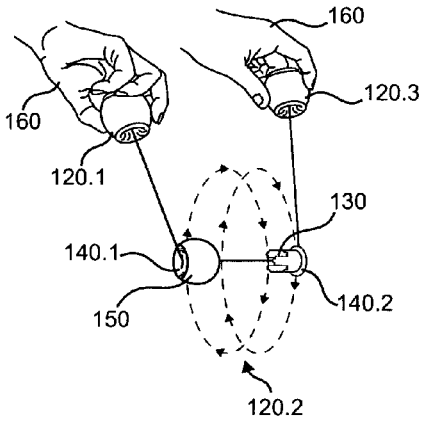
Figure 5C:
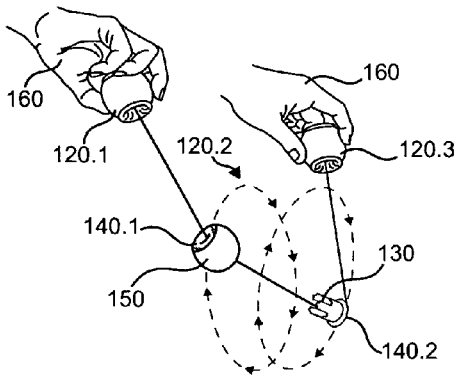
Figure 6A:
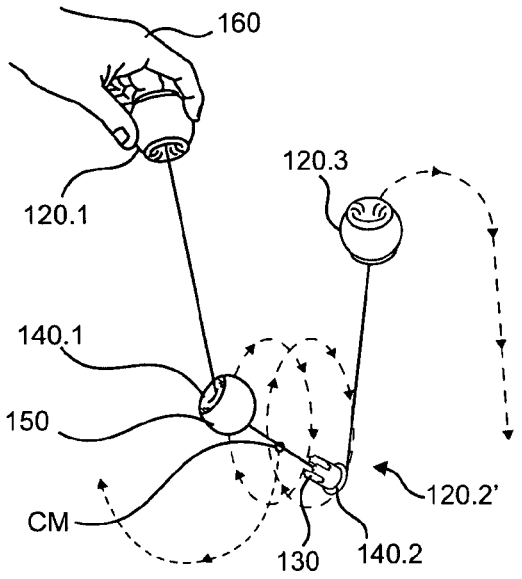
FIGS. 6A and 6B show a balanced orbit of the center of mass of a separated middle bob with an end bob.
Figure 6B:
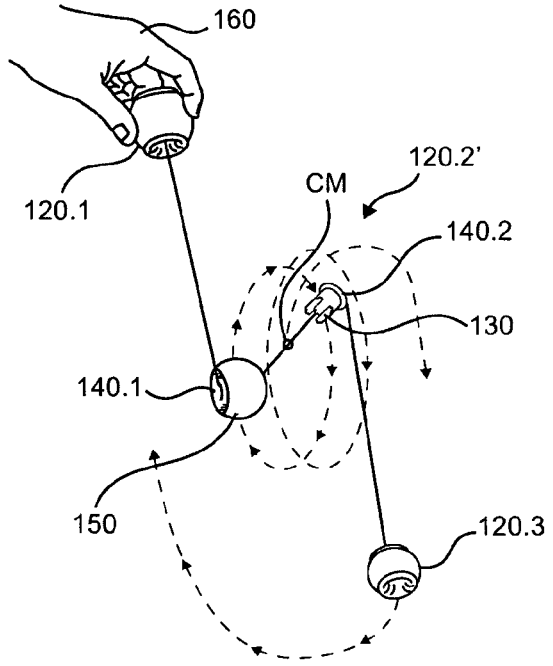

According to the present invention, the spindle halves (140) are considerably lighter than the weight (130) and the mantle (150). Therefore, when a bob (120') is in its separated state with one spindle half (140.2) holding the weight (130) while the separated components of the bob (120') are orbiting, the other spindle half (140.1) will tend to remain in the bore (152) of the mantle (150). According to a preferred embodiment of the present invention, the mantle (150) has roughly the same mass as the weight (130), i.e., $m_{weight} \approx m_{mantle}$. Therefore, the lower spindle half (140.2) with the weight (130) will orbit about the mantle (150) with the upper spindle half (140.1) in a balanced orbit. One such balanced orbit is depicted in FIGS. 5A-5C where the two end bobs (120.1) and (120.3) are held while the mantle (150) and first spindle half (140.1) orbits the weight (130) and second spindle half (140.2). When $m_{weight} \approx m_{mantle}$ (and therefore $m_{weight} + m_{spindle\ half} \approx m_{mantle} + m_{spindle\ half}$), the orbit shown in FIG. 5A-5C is a balanced orbit because the orbit would be the same if the mantle (150) and first spindle half (140.1) was replaced with the weight (130) and second spindle half (140.2) and vice versa, i.e., if the position of the mantle (150) and first spindle half (140.1) was switched with the weight (130) and second spindle half (140.2). The orbit of FIGS. 5A-5C can also be seen to be balanced because of the symmetry of the paths of the partial bobs (120') about the vertical plane between the two hands (160) and through the body of the player (not shown). Furthermore, because a bob (120') in its separated state still has a total mass equal to that of a bob (120) in its non-separated state, the center of mass of the two separated portions will orbit about a non-separated bob (120) in a balanced orbit. For instance, in the orbit depicted in FIGS. 6A and 6B one end bob (120.1) is held while the other end bob (120.3) orbits the center of mass (CM) of a separated middle bob (120.2') in a balanced orbit while the mantle (150) and first spindle half (140.1) of the separated middle bob (120.2') orbits the weight (130) and second spindle half (140.2) of the separated middle bob (120.2') in a balanced orbit. According to the present invention the mass $m_{mantle}$ of the mantle (150) is within 50%, more preferably 35%, still more preferably 20%, and still more preferably 10% of the mass $m_{weight}$ of the weight (130). Furthermore, according to the present invention the mass $m_{mantle}$ of the mantle (150) plus the mass $m_{spindle\ half}$ of a spindle half (140) is within 50%, more preferably 35%, still more preferably 20%, and still more preferably 10% of the mass $m_{weight}$ of the weight (130) plus the mass $m_{spindle\ half}$ of a spindle half (140).

According to the present invention, in the separated state the slideability of the components of a bob (120') along the string (105) are substantially different than that of a bob (120) in the non-separated state. In particular, in the non-separated state the smoothly-contoured bore (142) of the ajoined spindles (140.1) and (140.2) slides smoothly and with a low sliding friction along the string (105) since the string (105) is not forced to bend at a sharp angle when it enters and exits the flare (146) of the bore (142) at an angle relative to the bore axis (199). In contrast, in the separated state, as shown in FIG. 2B and in play in FIGS. 5A-5C and 6A-6B, the relatively sharp edge (151) at the end of the bore (152) of the mantle (150) forces the string (105) to bend at a sharp angle as it enters and exits the flare (146) of the bore (142) at an angle relative to the bore axis (199) and there is a high sliding friction. And the relatively sharp edge (131) at the end of the bore (132) of the weight (130) also forces the string (105) to bend at a sharp angle as it enters and exits the flare (146) of the bore (142) at an angle relative to the bore axis (199) and there is again an increased sliding friction relative to that of the non-separated bob (120). This allows moves requiring a higher sliding friction to be performed, such as the move shown in FIGS. 5A-5C. According to the preferred embodiment of the present invention, the radius of curvature in the cross-sectional plane shown in FIGS. 2A and 2B (which will be referred to in the present specification as the radius of curvature along the bore axis (199)) of the flare (146) of the bore (142) of a half spindle (140) is at least 4 times, more preferably 8 times, still more preferably 12 times, still more preferably 16 times, still more preferably 25 times, and still more preferably 50 times that of the radius of curvature along the bore axis (199) of the end (151) of the bore (152) of the mantle (150). Furthermore, according to the preferred embodiment of the present invention, the radius of curvature in the cross-sectional plane shown in FIGS. 2A and 2B of the flaring region (146) of the bore (142) of a half spindle (140) is at least 4 times, more preferably 8 times, still more preferably 12 times, still more preferably 16 times, still more preferably 25 times, and still more preferably 50 times that of the radius of curvature along the bore axis (199) of the end (131) of the bore (132) of the weight (130).

Figure 3:
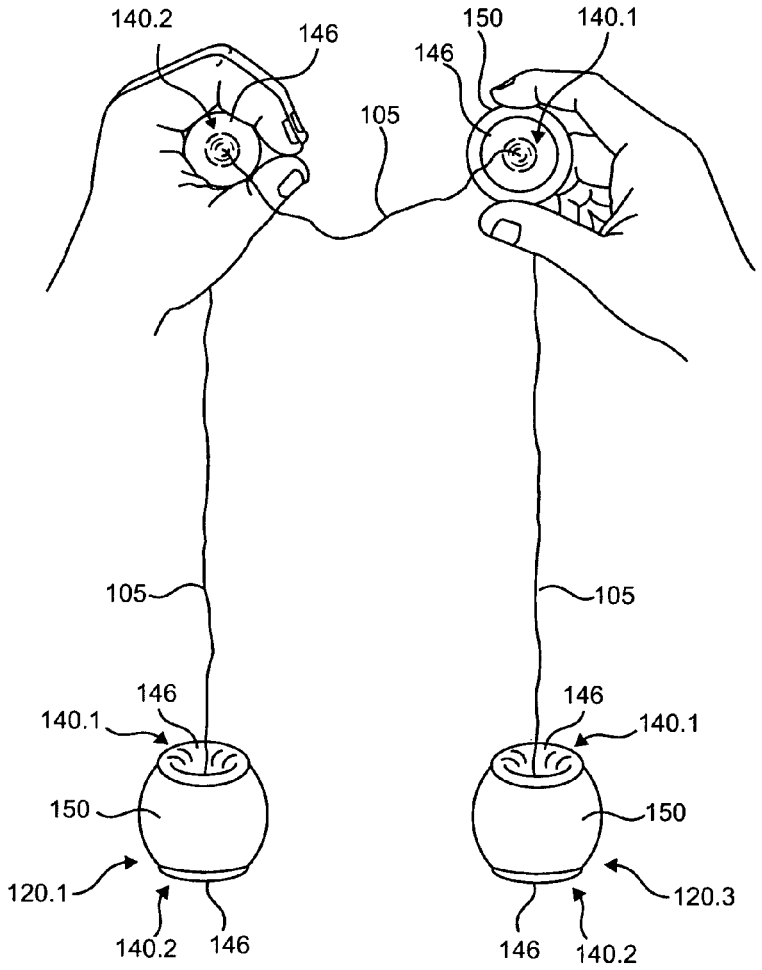
FIG. 3 shows the toy of the present invention with the middle bob in the separated state, held in a manner to provide an optical illusion.

It should also be noted that the separability of the bobs (120) provides the ability to produce optical or magical illusions where one bob (120) appears to become two bobs. As is apparent from FIG. 2B, the upper part of the separated-state bob (120') (i.e., the portion with the spindle (140.1) and mantle (150)) looks the same as a complete bob (120) from above along the bore axis (199) as well as from a range of angles off the bore axis (199). Because the width of the spindle (140) at the flaring end (146) of the bore (142) approaches that of mantle (150), the axially-central portion of the lower part of the separated-state bob (120') (i.e., the portion with the spindle (140.1) and weight (130)) can look almost the same as a complete bob (120) from below along the axis of cylindrical symmetry (199), particularly when held in a way that the region outside the spindle (140) is obscured by the hand as is shown in FIG. 3. According to the present invention, the diameter of the flared region (146) of the spindle half (140) is within 50%, more preferably 40%, still more preferably 30%, and even more preferably 20% of the diameter of the mantle (150).

Thus, it will be seen that the improvements presented herein are consistent with the objects of the invention for the toy described above. While the above description contains many specificities, these should not be construed as limitations on the scope of the invention, but rather as exemplifications of preferred embodiments thereof. Many other variations are within the scope of the present invention. For example: the bobs need not have the same construction—for instance, only one or two of the bobs may be reversibly separable; the spindle may have a different construction, such as not having three-fold symmetry or having a symmetry less than or greater than three-fold; one spindle half may have a stronger grip on the weight and may have a color different from a spindle half with a weaker grip on the weight; separated and non-separated bobs may have approximately equal areas along an axis other than the throughbore axis; a bob may be separable into more than two partial bobs, such as three, four or more partial bobs having roughly equal mass; etc. Accordingly, it is intended that the scope of the invention be determined not by the embodiments illustrated or the physical analyses motivating the illustrated embodiments, but rather by the appended claims and their legal equivalents.

What is claimed is:

1. A swinging bob toy comprising:

a tethering means, a first end bob constrained to said tethering means, a second end bob constrained to said tethering means, and a middle bob slidable on and constrained to said tethering means between said first and said second end bobs, one of the bobs selected from the group consisting of said first end bob, said second end bob and said middle bob being a selected bob having a mechanism for reversible attachment and separability which includes a lip which juts inwards towards a throughbore axis from an inwards-facing surface centered about said throughbore axis and a mating component having a cylindrical outer surface which can be removeably positioned in said inwards-facing surface so as to be removeably restrained by said inwards-jutting lip so said selected bob is reversibly separable into a first partial bob and a second partial bob, said first and second partial bobs being slidable on and constrained to said tethering means.

2. The swinging bob toy of claim 1 wherein said first partial bob has a first partial mass and said second partial bob has a second partial mass, said first partial mass being roughly equal to said second partial mass so as to produce balanced orbits of said first partial bob and said second partial bob.

3. The swinging bob toy of claim 1 wherein said first partial bob has a mass within 50% of said second partial bob.

4. The swinging bob toy of claim 1 wherein said first partial bob has a mass within 35% of said second partial bob.

5. The swinging bob toy of claim 1 wherein said first partial bob has a mass within 25% of said second partial bob.

6. The swinging bob toy of claim 1 wherein said first partial bob has a mass within 20% of said second partial bob.

7. The swinging bob toy of claim 1 wherein said first partial bob has a mass within 10% of said second partial bob.

8. The swinging bob toy of claim 1 wherein said first partial bob is reversibly separable into a first spindle half and a mantle, and said second partial bob is reversibly separable into a second spindle half and a weight said first spindle half and said second spindle half each has a spindle throughbore, a smooth flare at a first end of said spindle throughbore, and a reversible weight-retaining means at a second end of said spindle throughbore opposite said first end, said weight has a weight throughbore, said mantle has a mantle throughbore, said first and second spindles being mateable in a mating configuration where said weight-retaining means of said first spindle half and said second spindle half both secure said weight so said first and second spindles are reversibly attached such that said spindle throughbore of said first spindle half provides a continuation of said weight throughbore which provides a continuation of said spindle throughbore of said second spindle half.

9. The swinging bob toy of claim 8 wherein said first and second spindles have the same construction.

10. The swinging bob toy of claim 8 wherein said smooth flare of said spindle throughbore has a flare diameter, said mantle throughbore has a mantle throughbore diameter, said first and second spindles in said mating configuration fit into and span said mantle throughbore, and said flare diameter is greater than said mantle throughbore diameter so said mantle is securable between said first and second spindle halves in said mating configuration.

11. The swinging bob toy of claim 8 wherein said first and second spindles have three-fold symmetry.

12. The swinging bob toy of claim 1 wherein said first partial bob has a first slideability on said tethering means, said second partial bob has a second slideability on said tethering means, and said selected bob has a third slideability on said tethering means, said third slideability being substantially different from said first slideability and said second slideability, said first, second and third slideabilities being dependent on radii of curvature where said tethering means bends around said first partial bob, said second partial bob and said selected bob, respectively.

13. The swinging bob toy of claim 12 wherein said third slideability is substantially less than said first slideability and said second slideability.

14. The swinging bob toy of claim 12 wherein said first partial bob has a first throughbore with a first bore axis and a first radius of curvature along said bore axis, and said selected bob has a selected bob throughbore with a selected bob bore axis and a second radius of curvature along said selected bob bore axis, said second radius of curvature being at least 4 times greater than said first radius of curvature.

15. The swinging bob toy of claim 14 wherein said second radius of curvature is at least 8 times greater than a first radius of curvature.

16. The swinging bob toy of claim 14 wherein said second radius of curvature is at least 16 times greater than a first radius of curvature.

17. The swinging bob toy of claim 14 wherein said second radius of curvature is at least 25 times greater than a first radius of curvature.

18. The swinging bob toy of claim 14 wherein said second radius of curvature is at least 25 times greater than a first radius of curvature.

19. The swinging bob toy of claim 1 wherein said selected bob has a first diameter when viewed along a first throughbore of said selected bob, said first partial bob has a second diameter when viewed along a second throughbore of said first partial bob, said second diameter being within 50% of said first diameter.

20. The swinging bob toy of claim 19 wherein said second diameter is within 40% of said first diameter.

21. The swinging bob toy of claim 19 wherein said second diameter is within 30% of said first diameter.

22. The swinging bob toy of claim 19 wherein said second diameter is within 20% of said first diameter.

* * * * *

UNITED STATES PATENT AND TRADEMARK OFFICE

CERTIFICATE OF CORRECTION

PATENT NO. : 9,004,978 B2
APPLICATION NO. : 13/714419
DATED : April 14, 2015
INVENTOR(S) : Shaw It is certified that error appears in the above-identified patent and that said Letters Patent is hereby corrected as shown below:

In the Claims

Claim 8, column 6, line 61 replace “weight said” with --weight, said--.

Claim 8, column 6, line 67 replace “first and second spindles” with --first and second spindle halves--.

Claim 8, column 7, line 3 replace “first and second spindles” with --first and second spindle halves--.

Claim 9, column 7, lines 8-9 replace “first and second spindles” with --first and second spindle halves--.

Claim 10, column 7, line 13 replace “first and second spindles” with --first and second spindle halves--.

Claim 11, column 7, lines 18-19 replace “first and second spindles” with --first and second spindle halves--.

Signed and Sealed this
Thirtieth Day of June, 2015

Michelle K. Lee

Michelle K. Lee
*Director of the United States Patent and Trademark Office*